US007466309B2

(12) United States Patent
Hunt et al.

(10) Patent No.: US 7,466,309 B2
(45) Date of Patent: Dec. 16, 2008

(54) DISPLAY SYSTEM AND METHOD USING A PROJECTOR AND A REFLECTIVE DISPLAY

(75) Inventors: Robert W. G. Hunt, Salisbury (GB); Sabine Susstrunk, Lausanne (CH); Jack M. Holm, San Jose, CA (US); Gary J. Dispoto, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 748 days.

(21) Appl. No.: 11/004,161

(22) Filed: Dec. 3, 2004

(65) Prior Publication Data

US 2006/0119625 A1 Jun. 8, 2006

(51) Int. Cl.
*G09G 5/00* (2006.01)

(52) U.S. Cl. ..... 345/204; 345/30

(58) Field of Classification Search ..... 345/30–37, 345/63, 102, 204; 349/61, 8, 73–77; 359/452, 359/645; 353/31, 48, 82, 87–94, 34, 28; 348/751, 752, 778–780, 800–803
See application file for complete search history.

(56) References Cited

U.S. PATENT DOCUMENTS 5,815,221 A * 9/1998 Kojima et al. ..... 348/751
5,864,426 A * 1/1999 Songer ..... 359/452
6,170,953 B1 * 1/2001 Lee et al. ..... 353/82
6,307,681 B1 * 10/2001 Aoki et al. ..... 359/645
6,478,429 B1 11/2002 Aritake et al.
6,683,726 B2 1/2004 Endo et al.
6,688,748 B2 2/2004 Lewis et al.
6,746,329 B1 6/2004 Duhamel
6,753,846 B2 6/2004 Takeuchi et al.
2003/0081151 A1 * 5/2003 Tsuchihashi et al. ..... 349/61
2006/0061538 A1 * 3/2006 Dispoto et al. ..... 345/102

OTHER PUBLICATIONS

Dispoto et al., Patent application entitled "Display Method and System Using Transmissive and Emissive Components" U.S. Appl. No. 10/948,473, filed Sep. 23, 2004.

* cited by examiner

*Primary Examiner*—Nitin Patel

(57) ABSTRACT

A display system comprising a reflective display configured to display a luminance component associated with a color input signal and a projector configured to project a chrominance component associated with the color input signal onto the reflective display is provided. The reflective display is configured to reflect the chrominance component.

34 Claims, 3 Drawing Sheets

DISPLAY SYSTEM AND METHOD USING A PROJECTOR AND A REFLECTIVE DISPLAY

BACKGROUND

Display devices may include any number of technologies from a traditional cathode ray tube (CRT) to digital light processor (DLP) projection displays with digital micro-mirror devices (DMD). Regardless of display technology, one of the measures used to evaluate the quality of a display device is resolution. One determinant of the resolution of a display device is the number of pixels of the device. A display device with a higher number of pixels generally has a higher resolution than a comparable display device with a lower number of pixels. An increased number of pixels in a display device often involves higher costs for the display. With an increased number of pixels, the amount of processing power or information for each image that is provided to a display device may also increase to provide values for the additional pixels.

Dynamic range is another quality factor of a display device. The larger the dynamic range, the more vibrant the colors appear. It would be desirable to be able to provide a relatively high resolution, high-dynamic display device while minimizing the cost, processing power and/or information needed to display images.

SUMMARY

One form of the present invention provides a display system comprising a reflective display configured to display a luminance component associated with a color input signal and a projector configured to project a chrominance component associated with the color input signal onto the reflective display. The reflective display is configured to reflect the chrominance component.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

The human visual system has approximately one-fourth of the linear acuity for chrominance as it does for luminance. As a result, the chrominance signal for an image may include only one-sixteenth of the information in the luminance signal for the image on an area basis. A display system that may exploit this concept is described herein.

As described herein, a display system is provided that includes a projector and a reflective display. Using a color input signal, the projector projects a chrominance component of the color input signal onto the reflective display. The reflective display reflects the chrominance component of the color input signal provided by the projector and simultaneously displays a luminance component of the color input signal. The reflected chrominance component and the displayed luminance component combine to reproduce an image or images provided by the color input signal. The chrominance component projected by the projector may be a lower resolution than the luminance component displayed by the reflective display.

Figure 1:
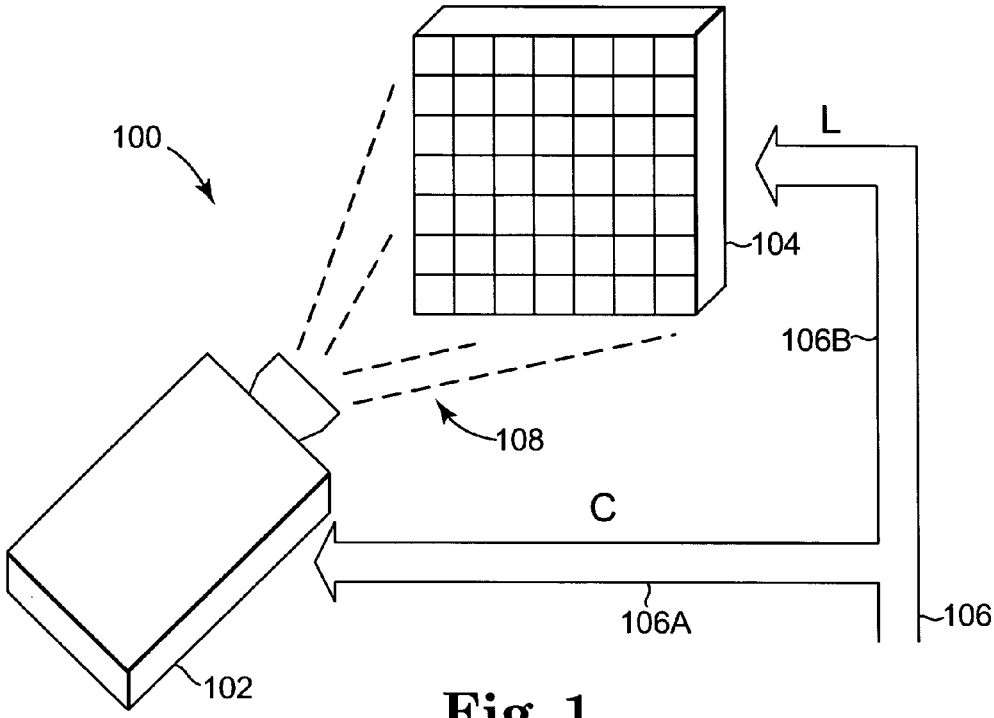
FIG. 1 is a schematic diagram illustrating a display system according to one embodiment of the present invention.

FIG. 1 is a schematic diagram illustrating a display system 100. Display system 100 comprises a projector 102 and a reflective display 104. Display system 100 receives a color input signal 106. Reflective display 104 has a resolution that is greater than or equal to the resolution of projector 102. Color input signal 106 has a chrominance portion 106A that is provided to projector 102 and a luminance portion 106B that is provided to reflective display 104. Chrominance portion 106A and luminance portion 106B each comprise values configured to drive the individual pixels or sub-pixel components of projector 102 and reflective display 104, respectively.

Projector 102 projects a chrominance component associated with color input signal 106 onto reflective display 104 using chrominance portion 106A of color input signal 106 as represented by dashed lines 108. Projector 102 may be any type of projector configured to cause a chrominance component of color input signal 106 to be projected. Examples of such a projector include a color digital light processor (DLP) projector which includes one or more digital micro-mirror devices (DMD), a color liquid crystal display (LCD) projector, and any other conventional color projector.

Reflective display 104 reflects the chrominance component provided by projector 102. Simultaneously with reflecting the chrominance component associated with color input signal 106, reflective display 104 displays a luminance component associated with color input signal 106 using luminance portion 106B of color input signal 106. Reflective display 104 may be any type of reflective display configured to reflect a projected chrominance component and display a received luminance component. Accordingly, reflective display 104 may be a monochrome reflective display. Other examples of a reflective display include color and monochrome electronic paper and a color and monochrome reflective liquid crystal display (LCD).

The reflected chrominance component and the displayed luminance component from reflective display 104 combine to reproduce an image or images provided by color input signal 106. The reproduced image may appear to the human visual system as having the resolution of reflective display 104 even where projector 102 has a lower resolution than reflective display 104. Color input signal 106 may comprise any type of image data for use in displaying still images, video images, graphics, or text with display system 100. The image data comprises chrominance data that forms chrominance portion 106A of color input signal 106 and luminance data that forms the luminance portion 106B of color input signal 106.

Reflective display 104 has a resolution of n horizontal pixels and m vertical pixels, where n and m are whole numbers that may or may not be equal, for a total of n times m pixels. The aspect ratio of reflective display 104 may be 4:3, 16:9, or any other suitable ratio. In one embodiment, projector 102 has a total number of pixels p as defined by Equation 1.

$$p = \frac{n \times m}{x^2} \qquad \text{Equations I}$$

where $x$ is an integer greater than or equal to 1 (*e.g.*, $x = 4$).

In this embodiment, projector 102 has the same aspect ratio of reflective display 104. Accordingly, reflective display 104 has a higher resolution than projector 102 in this embodiment. In other embodiments, projector 102 may have other numbers of pixels relative to reflective display 104.

Each pixel of projector 102 and reflective display 104 may comprise multiple sub-pixel components, e.g., red, blue and green components. Accordingly, projector 102 projects the chrominance component of color input signal 106 using the sub-pixel components of the pixels of projector 102, and reflective display 104 displays the luminance component of color input signal 106 using the sub-pixel components of the pixels of reflective display 104.

In the embodiment of FIG. 1, color input signal 106 includes chrominance portion 106A and luminance portion 106B. In the embodiments shown in FIGS. 2A and 2B, a color input signal is converted from one color space or color representation into chrominance and luminance components that are provided to projector 102 and reflective display 104, respectively. The values of chrominance portion 102A and luminance portion 102B may be transformed or mapped to the color gamuts and viewing conditions associated with projector 102 and reflective display 104, respectively, prior to being provided to projector 102 and reflective display 104, respectively. In addition, the chrominance portion 102A may be down-sampled to match the resolution of projector 102.

Figure 2A:
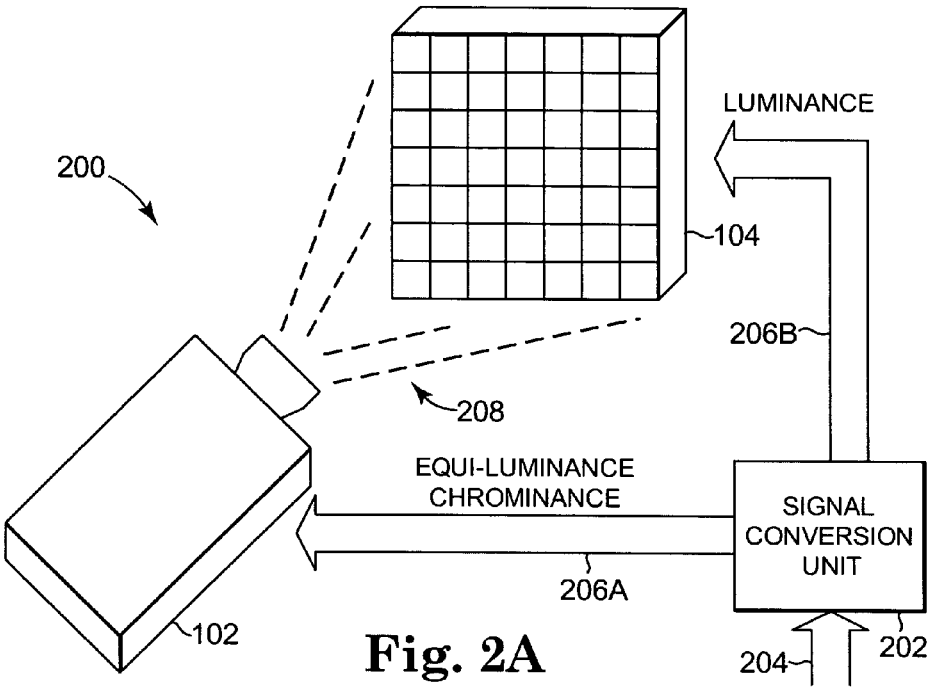
FIGS. 2A and 2B are schematic diagrams illustrating display systems according to embodiments of the present invention.

FIG. 2A is a schematic diagram illustrating a display system 200. In FIG. 2A, display system 200 includes projector 102, reflective display 104, and a signal conversion unit 202.

Signal conversion unit 202 receives a color input signal 204. Color input signal 204 may comprise any type of image data for use in displaying still images, video images, graphics, or text with display system 200. Color input signal 204 may be received by signal conversion unit 202 in any color encoding or color representation such as RGB, sRGB, YCC, YCrCb, CIELAB, YUV, LUV, YIQ, and others. Signal conversion unit 202 generates an equi-luminance chrominance signal 206A and a luminance signal 206B from color input signal 204. Equi-luminance chrominance signal 206A and luminance signal 206B comprise values configured to drive the individual pixels or sub-pixel components of projector 102 and reflective display 104, respectively.

Signal conversion unit 202 generates equi-luminance chrominance signal 206A and luminance signal 206B by decomposing color input signal 204 into equi-luminance chrominance and luminance components and transforming or mapping the equi-luminance chrominance and luminance components into the color gamuts associated with projector 102 and reflective display 104, respectively. In addition, signal conversion unit 202 may down-sample equi-luminance chrominance signal 206A to match the resolution of projector 102.

Signal conversion unit 202 generates equi-luminance chrominance signal 206A such that signal 206A is configured to drive the individual pixels or the individual sub-pixel components of projector 102. In particular, signal 206A is configured to drive the individual pixels or individual sub-pixel components with equal amounts of luminance (i.e., equi-luminance) and with chrominance amounts associated with color input signal 204. In generating signal 206A, signal conversion unit 202 accesses information associated with projector 102 (not shown) to adjust or calibrate the values for the individual pixels or the individual sub-pixel components in signal 206A to values appropriate for projector 102 using a transform function or mapping. Signal conversion unit 202 provides equi-luminance chrominance signal 206A to projector 102.

Signal conversion unit 202 generates luminance signal 206B such that signal 206B is configured to drive reflective display 104 directly. In generating signal 206B, signal conversion unit 202 accesses information associated with reflective display 104 (not shown) to adjust or calibrate the values for the individual pixels or the individual sub-pixel components in signal 206B to values appropriate for reflective display 104 using a transform function or mapping. Signal conversion unit 202 provides luminance signal 206B to reflective display 104.

Projector 102 receives equi-luminance chrominance signal 206A from signal conversion unit 202. Projector 102 projects a chrominance component associated with color input signal 204 along with an equi-luminance component associated with color input signal 204 onto reflective display 104 using equi-luminance chrominance signal 206A as represented by dashed lines 208. The equi-luminance component causes equal amounts of luminance to be projected onto reflective display 104.

Reflective display 104 receives luminance signal 206B from signal conversion unit 202. Reflective display 104 reflects the chrominance and equi-luminance components provided by projector 102. Simultaneously with reflecting the chrominance and equi-luminance components associated with color input signal 204, reflective display 104 displays a luminance component associated with color input signal 204 using luminance signal 206B.

The reflected equi-luminance component and chrominance component and the displayed luminance component from reflective display 104 combine to reproduce an image or images provided by color input signal 204.

In one embodiment of FIG. 2A, projector 102 generates the equi-luminance component using red, green, and blue sub-pixel components for each pixel. In this embodiment, the maximum value of the equi-luminance component may be equal to the minimum luminance of the red, green, and blue sub-pixel components to achieve display chromaticies of the individual pixels of projector 102. If reflective display 104 only reduces the amount of light, the maximum value of the equi-luminance component represents the maximum value of the luminance of display system 200.

In one embodiment, the luminance of display system 200 may be increased by having reflective display 104 emit more light at selective positions to provide for a brighter display and provide for a higher dynamic range, i.e., higher contrast, display. As a result, the color saturation of display system 200 may decrease.

Because projector 102 projects the equi-luminance component to reflective display 104 in the embodiment shown in FIG. 2A, the pixels projected by projector 102 may not need to be precisely aligned with the pixels displayed by reflective display 104.

Figure 2B:
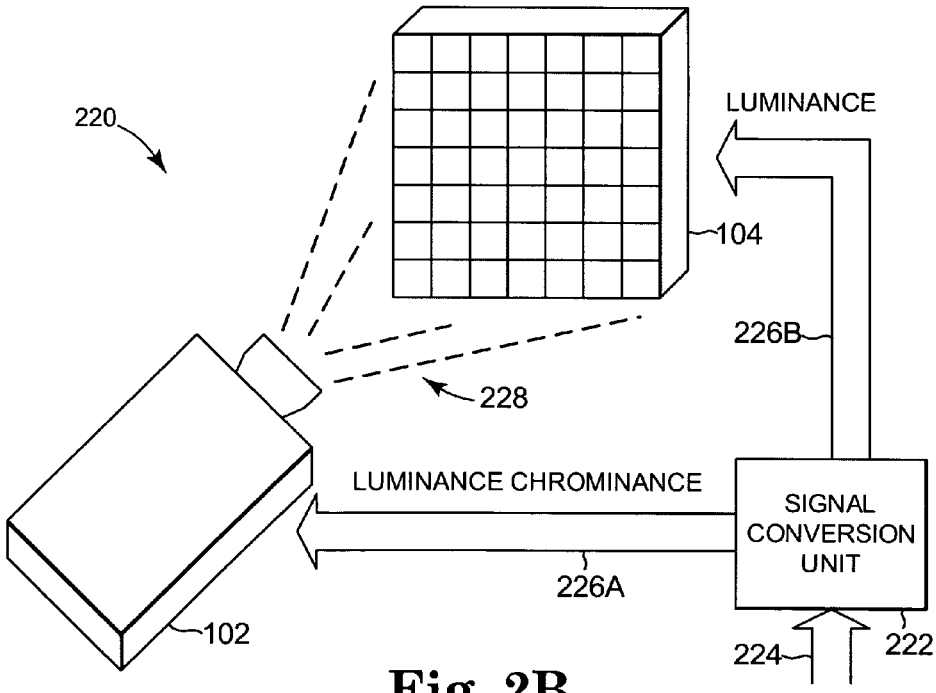

FIG. 2B is a schematic diagram illustrating a display system 220. In FIG. 2B, display system 220 includes projector 102, reflective display 104, and a signal conversion unit 222.

Signal conversion unit 222 receives a color input signal 224. Color input signal 224 may comprise any type of image data for use in displaying still images, video images, graphics, or text with display system 220. Color input signal 224 may be received by signal conversion unit 222 in any color encoding or color representation such as RGB, sRGB, YCC, YCrCb, CIELAB, YUV, LUV, YIQ, and others. Signal conversion unit 222 generates a luminance chrominance signal 226A and a luminance signal 226B from color input signal 224. Luminance chrominance signal 226A and luminance signal 226B comprise values configured to drive the individual pixels or sub-pixel components of projector 102 and reflective display 104, respectively.

Signal conversion unit 222 generates luminance chrominance signal 226A and luminance signal 226B by decomposing color input signal 224 into luminance chrominance and luminance components and transforming or mapping the luminance chrominance and luminance components into the color gamuts associated with projector 102 and reflective display 104, respectively. In addition, signal conversion unit 222 may down-sample luminance chrominance signal 226A to match the resolution of projector 102.

Signal conversion unit 222 generates luminance chrominance signal 226A such that signal 226A is configured to drive the individual pixels or the individual sub-pixel components of projector 102 with luminance and chrominance amounts associated with color input signal 224. In particular, signal 226A is configured to drive the individual pixels or individual sub-pixel components with variable amounts of luminance and with chrominance amounts associated with color input signal 224. In generating signal 226A, signal conversion unit 222 accesses information associated with projector 102 (not shown) to adjust or calibrate the values for the individual pixels or the individual sub-pixel components in signal 226A to values appropriate for projector 102 using a transform function or mapping. Signal conversion unit 222 provides luminance chrominance signal 226A to projector 102.

Signal conversion unit 222 generates luminance signal 226B such that signal 226B is configured to drive reflective display 104 directly. In generating signal 226B, signal conversion unit 222 accesses information associated with reflective display 104 (not shown) to adjust or calibrate the values for the individual pixels or the individual sub-pixel components in signal 226A to values appropriate for reflective display 104 using a transform function or mapping. Signal conversion unit 222 provides luminance signal 226B to reflective display 104.

Projector 102 receives luminance chrominance signal 226A from signal conversion unit 222. Projector 102 projects a luminance chrominance component associated with color input signal 224 onto reflective display 104 using luminance chrominance signal 226A as represented by dashed lines 228.

Reflective display 104 receives luminance signal 226B from signal conversion unit 222. Reflective display 104 reflects the luminance chrominance component provided by projector 102. Simultaneously with reflecting the luminance chrominance component associated with color input signal 224, reflective display 104 displays a luminance component associated with color input signal 224 using luminance signal 226B.

The reflected luminance chrominance component and the displayed luminance component from reflective display 104 combine to reproduce an image or images provided by color input signal 224.

In the embodiment of FIG. 2B, the luminance of each pixel from projector 102, i.e., the chrominance pixels, may be equal to the maximum luminance of the corresponding pixels from reflective display 104, i.e., the luminance pixels. The luminance of the corresponding luminance pixels may be offset such that it filters the maximum luminance to produce the actual luminance.

In one embodiment, the luminance of the luminance pixels may be additionally increased or decreased to create a high-dynamic display system 220 that may have a dynamic range, i.e., contrast, equal to the dynamic range of projector 102 times the dynamic range of reflective display 104.

In the embodiment shown in FIG. 2B, the pixels projected by projector 102 may be precisely aligned with the pixels displayed by reflective display 104.

Figure 3:
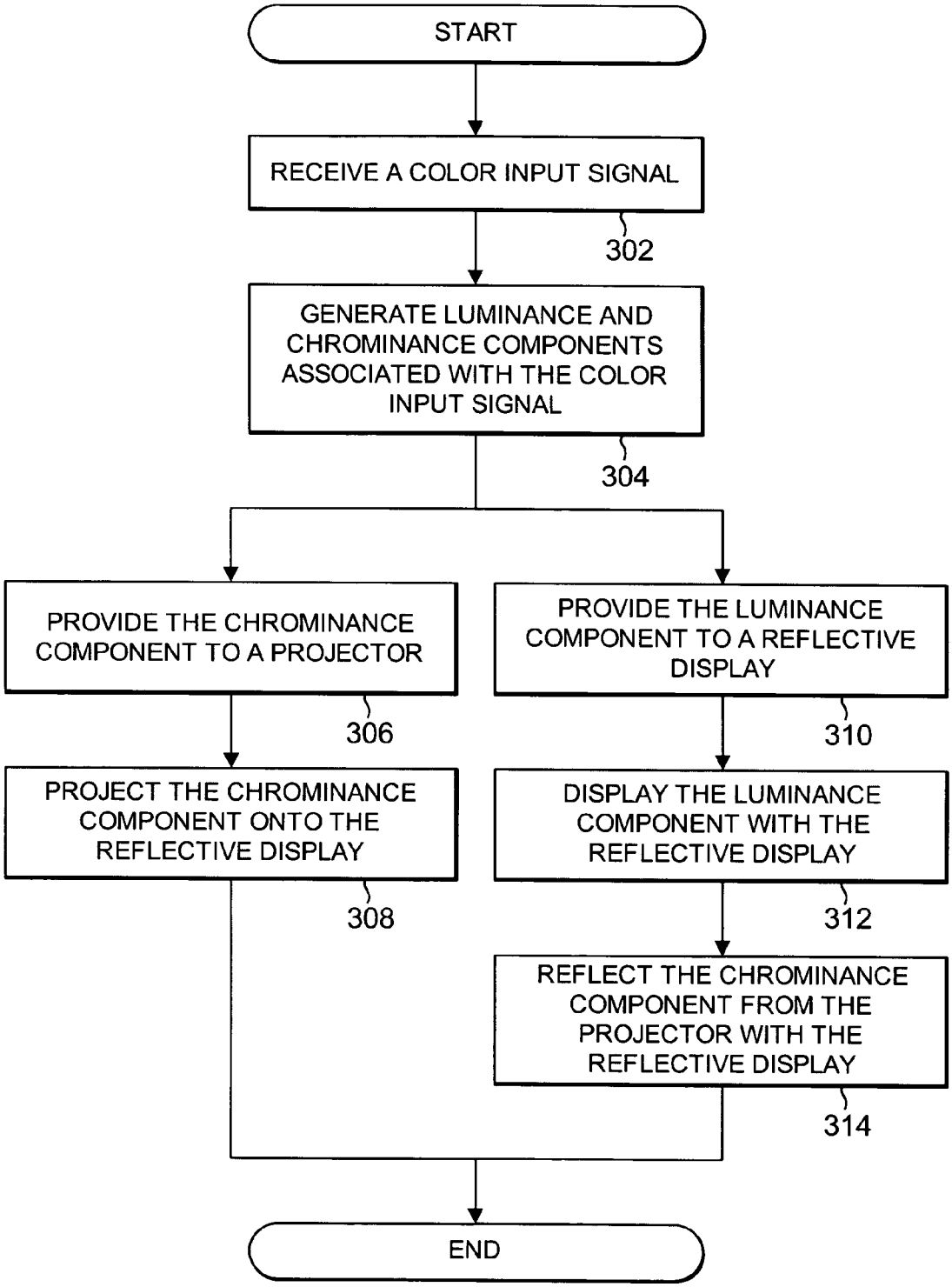
FIG. 3 is a flow chart illustrating a display method using a projector and a reflective display according to one embodiment of the present invention.

FIG. 3 is a flow chart illustrating a display method using projector 102 and reflective display 104. In FIG. 3, a color input signal is received as indicated by a block 302. The color input signal may be received with defined luminance and chrominance encoding, as in the embodiment of FIG. 1, or in a non-luminance/chrominance encoding, as in the embodiments of FIGS. 2A and 2B. Luminance and chrominance components associated with the color input signal are generated, if necessary, as indicated in a block 304.

The chrominance component is provided to projector 102 as indicated in a block 306. Projector 102 projects the chrominance component onto reflective display 104 as indicated in a block 308. The chrominance component projected by projector 102 may also include an equi-luminance or luminance component as described above with reference to FIGS. 2A and 2B, respectively.

Contemporaneously with the function in block 306, the luminance component is provided to reflective display 104 as indicated in a block 310. Reflective display 104 displays the luminance component as indicated in a block 312. Reflective display 104 also reflects the chrominance component and any equi-luminance or luminance component from projector 102 as indicated in a block 314.

In one embodiment, systems 100, 200, and 220 may be operated in one of two modes of operation. In a first mode of operation, projector projects a chrominance component onto reflective display 104 and reflective display 104 reflects the chrominance component and displays a luminance component as described above with reference to systems 100, 200, and 220. In a second mode of operation, reflective display 104 operates separately from projector 102 to display a luminance component (i.e., projector 102 is not used) to recreate still or video images in each of systems 100, 200, and 220.

Figure 4:
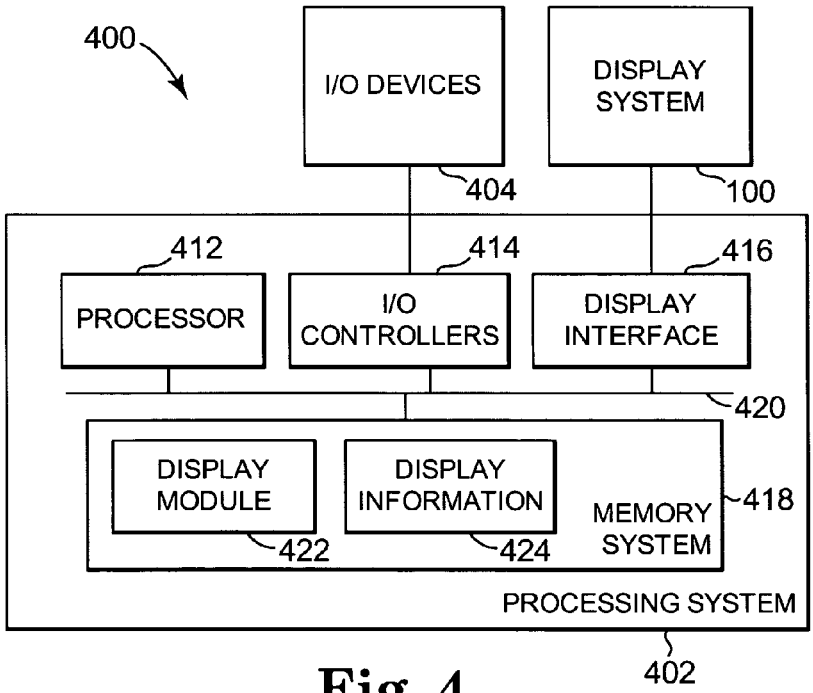
FIG. 4 is a block diagram illustrating a processing system according to one embodiment of the present invention.

FIG. 4 is a block diagram illustrating a processing system 400. Processing system 400 comprises a processing system 402, input/output (I/O) devices 404, and display system 100.

Processing system 402 may be any type of application specific integrated circuit (ASIC), computer system, or control system such as desktop, mobile, workstation, or server computer. Processing system 402 may be separate from display system 100 or may be integrated into a housing (not shown) a portion of display system 100 such as projector 102. Processing system 402 comprises one or more processors 412, a plurality of input/output (I/O) controllers 414, a display interface 416, a memory system 418, and one or more connections 420 between processors 412, input/output (I/O) controllers 414, display interface 416 and memory system 418. Processing system 402 may also include an operating system (not shown) or firmware (not shown) that is executable by processor 412. Processor 412 executes instructions and accesses information stored in memory system 418. In particular, processor 412 is configured to execute a display module 422 and access display information 424.

Memory system 418 includes display module 422 and display information 424. Memory system 418 may include any type and number of volatile and non-volatile memory devices such as a FLASH memory, a RAM, and a hard disk drive.

I/O devices 404 may include any type and number of devices configured to communicate with processing system 402. Each device may be internal or external to processing system 402. Display module 422 and display information 424 may be read from or stored to an external medium using an I/O device 404 such as a CD-ROM or floppy disk. I/O devices 404 may include a wired or wireless network device (not shown) configured to communicate with one or more external networks (not shown). In such embodiments, processing system 402 may be configured to transmit or receive display module 422 and display information 424 and/or updates to display module 422 and display information 424 to a remote storage device (not shown) using the network device.

Processor 412 executes instructions in display module 422 to control the operation of display system 100. For example, processor 412 executes instructions in display module 422 to cause the luminance and chrominance components associated with a color input signal to be generated and/or provided to display system 100. More particularly, processor 412 executes instructions in display module 422 to convert the color input signal from a first color encoding or color representation, e.g., RGB, sRGB, YCC, YCrCb, CIELAB, YUV, LUV, YIQ, and others, into the luminance and chrominance components for display system 100.

The color input signal may be received from display interface 416, one or more of I/O devices 404, or from one or more ports (not shown) of processing system 402. Display module 422 may be any kind of software such as a device driver, an application, or firmware associated with display system 100.

In executing display module 422, processor 412 may access information from display information 424 to generate the luminance and chrominance components. Display information 424 may include one or more tables associating values received from the color input signal with the luminance and chrominance components, calibration information associated with display system 100, or other information.

In other embodiments, display system 100 may be replaced with display system 200 of FIG. 2A or display system 220 of FIG. 2B. In these embodiments, processor 412 executes instructions in display module 422 to perform the functions described above with respect to signal conversion units 202 and 222, respectively.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A display system comprising:

a reflective display configured to receive a luminance component associated with a color input signal and display the luminance component; and a projector configured to receive a chrominance component associated with the color input signal separately from the luminance component provided to the reflective display and project the chrominance component onto the reflective display;

wherein the reflective display is configured to reflect the chrominance component while displaying the luminance component.

2. The display system of claim 1 further comprising:

a signal conversion unit configured to receive the color input signal;

wherein the signal conversion unit is configured to generate the luminance component and the chrominance component using the color input signal, wherein the signal conversion unit is configured to provide the luminance component to the reflective display, and wherein the signal conversion unit is configured to provide the chrominance component to the projector.

3. The display system of claim 2 wherein the signal conversion unit is configured to generate an equi-luminance component using the color input signal, wherein the signal conversion unit is configured to provide the equi-luminance component to the projector, wherein the projector is configured to project the equi-luminance component, and wherein the reflective display is configured to reflect the equi-luminance component.

4. The display system of claim 2 wherein the chrominance component comprises a luminance chrominance component, wherein the signal conversion unit is configured to provide the luminance chrominance component to the projector, wherein the projector is configured to project the luminance chrominance component, and wherein the reflective display is configured to reflect the luminance chrominance component.

5. The display system of claim 1 wherein the reflective display has a first resolution, and wherein the projector has a second resolution that is less than or equal to the first resolution.

6. The display system of claim 1 wherein the color input signal comprises an image, and wherein the reflective display is configured to display the luminance and reflect the chrominance component to reproduce the image.

7. The display system of claim 6 wherein the image is selected from the group consisting of still images, video images, graphics, and text.

8. The display system of claim 1 wherein the reflective display is configured to reflect the chrominance component substantially simultaneously with displaying the luminance component.

9. The display system of claim 1 wherein the projector comprises a digital light processor (DLP) projector.

10. The display system of claim 1 wherein the projector comprises a liquid crystal display (LCD) projector.

11. The display system of claim 1 wherein the reflective display comprises electronic paper.

12. The display system of claim 1 wherein the reflective display comprises a reflective liquid crystal display (LCD).

13. The display system of claim 1 wherein the reflective display comprises a monochrome display.

14. A method for displaying an image, the method comprising:

projecting a chrominance component of the image onto a reflective display; and displaying a luminance component of the image received separately from the chrominance component using the reflective display.

15. The method of claim 14 further comprising:

displaying the luminance component of the image using the reflective display substantially simultaneously with projecting the chrominance component.

16. The method of claim 15 further comprising:

reflecting the chrominance component from the reflective display.

17. The method of claim 14 further comprising:

generating the chrominance component using a color input signal associated with the image; and generating the luminance component using the color input signal.

18. The method of claim 17 further comprising:

generating an equi-luminance component using the color input signal; and projecting the equi-luminance component onto the reflective display.

19. The method of claim 14 further comprising:

generating the chrominance component using a color input signal associated with the image such that the chrominance component comprises a luminance chrominance component; and generating the luminance component using the color input signal.

20. The method of claim 17 wherein the reflective display has a first resolution, and wherein the projector has a second resolution that is less than or equal to the first resolution.

21. The method of claim 17 wherein the image is selected from the group consisting of still images, video images, graphics, and text.

22. A display system comprising:

means for receiving a first luminance component associated with a color input signal separately from a chrominance component associated with the color input signal;

means for displaying the first luminance component; and means for projecting the chrominance component onto the means for displaying the first luminance component.

23. The display system of claim 22 further comprising:

means for generating the first luminance component and the chrominance component using the color input signal;

means for providing the first luminance component to the means for receiving; and means for providing the chrominance component to the means for projecting.

24. The display system of claim 23 further comprising:

means for generating an equi-luminance component using the color input signal; and means for providing the equi-luminance component to the means for projecting;

wherein the means for projecting includes means for projecting the equi-luminance component.

25. The display system of claim 23 further comprising:

means for generating a second luminance component using the color input signal; and means for providing the second luminance component to the means for projecting;

wherein the means for projecting includes means for projecting the second luminance component.

26. The display system of claim 22 wherein the means for displaying has a first resolution, and wherein the means for projecting has a second resolution that is less than or equal to the first resolution.

27. The display system of claim 22 wherein the means for displaying has a first number of pixels, and wherein the means for projecting has a second number of pixels that is less than or equal to the first number of pixels.

28. The display system of claim 22 wherein the color input signal comprises an image, and wherein the image is selected from the group consisting of still images, video images, graphics, and text.

29. A computer-readable medium having computer-executable instructions for performing a method comprising:

generating a first luminance component of an image using a color input signal;

generating a chrominance component of the image using the color input signal;

providing the first luminance component of the image to a reflective display; and providing the chrominance component of the image to a projector separately from providing the first luminance component to the reflective display.

30. The computer-readable medium of claim 29 having computer-executable instructions for performing the method further comprising:

generating an equi-luminance component of the image using the color input signal; and providing the equi-luminance component of the image to a projector.

31. The computer-readable medium of claim 29 having computer-executable instructions for performing the method further comprising:

generating a second luminance component of the image using the color input signal; and providing the second luminance component of the image to a projector.

32. The computer-readable medium of claim 29 wherein the reflective display has a first resolution, and wherein the projector has a second resolution that is less than or equal to the first resolution.

33. The computer-readable medium of claim 29 wherein the color input signal comprises an image, and wherein the image is selected from the group consisting of still images, video images, graphics, and text.

34. The computer-readable medium of claim 29 wherein the projector is configured to project the chrominance component, and wherein the reflective display is configured to display the luminance component and reflect the chrominance component projected by the projector.

* * * * *